US007383867B2

(12) United States Patent
Fraczak et al.

(10) Patent No.: US 7,383,867 B2
(45) Date of Patent: Jun. 10, 2008

(54) FILM SPLICING MACHINE

(75) Inventors: Tadeusz Fraczak, Silverwater (AU); Deni Ferfolja, Bexley (AU)

(73) Assignee: TNA Australia Pty Limited, Lidcombe, New South Wales (AU)

( * ) Notice: Subject to any disclaimer, the term of this patent is extended or adjusted under 35 U.S.C. 154(b) by 188 days.

(21) Appl. No.: 11/001,562

(22) Filed: Nov. 30, 2004

(65) Prior Publication Data

US 2005/0139310 A1 Jun. 30, 2005

(30) Foreign Application Priority Data

Nov. 27, 2003 (AU) ..... 2003906597

(51) Int. Cl.
*B65H 21/00* (2006.01)

(52) U.S. Cl. ..... 156/507; 156/157; 156/502; 242/551

(58) Field of Classification Search ..... 156/157, 156/159, 304.1, 304.3, 502, 504, 505, 507; 242/555.1, 555.2, 555.4, 556.1
See application file for complete search history.

(56) References Cited

U.S. PATENT DOCUMENTS 3,920,502 A * 11/1975 Tokuno ..... 156/504
4,564,413 A * 1/1986 Murakami ..... 156/504
5,679,195 A * 10/1997 O'Dwyer et al. ..... 156/159
5,975,457 A 11/1999 Forbes
6,161,793 A * 12/2000 Lindstrand ..... 242/556
6,786,264 B1 * 9/2004 Torres Martinez ..... 156/504
2002/0139891 A1 10/2002 Taylor

FOREIGN PATENT DOCUMENTS

| | | | |
|---|---|---|---|
| EP | 1074497 | A1 | 2/2001 |
| ES | 850463 | A1 | 7/1985 |
| ES | 2234357 | A1 | 6/2005 |
| NL | 1026891 | A | 11/2005 |

* cited by examiner

*Primary Examiner*—Mark A Osele
(74) *Attorney, Agent, or Firm*—Townsend and Townsend and Crew, LLP

(57) ABSTRACT

A splicing machine (10) to join strip material, the strip material being intended to be delivered to a packaging machine. The splicing machine (10) supports two rolls of strip material on supports (12, 13), with the strip material being taken from one of the rolls. When the material taken from one roll becomes depleted the trailing end of the material is engaged by a first web securing member (18). A second web securing member (19) engages and retains the leading portion of the next roll. The trailing portion of the first roll is then joined to the leading portion of the next roll so that the strip material is continuously delivered to an associated packaging machine.

20 Claims, 6 Drawing Sheets

FILM SPLICING MACHINE

TECHNICAL FIELD

The present invention relates to machines that deliver strip material and more particularly but not exclusively to machines that deliver strip material to packaging machines that use the strip material to form bags.

BACKGROUND OF THE INVENTION

Packaging machines receive strip bag material formed of plastics material, and form therefrom bags containing a product.

The strip bag material is delivered by a film delivery device that generally supports two rolls of the material. The packaging machine is stopped and the trailing portion of the depleted roll is joined to the leading portion of the next roll to be used. The join is effected manually.

The above discussed previous apparatus and method for joining the bag material (plastic film) has disadvantage that the packaging machine is inoperative for a considerable time while the bag material is being joined.

OBJECT OF THE INVENTION

It is the object of the present invention to overcome or substantially ameliorate the above disadvantage.

SUMMARY OF THE INVENTION

There is disclosed herein a splicing machine to join flexible strip material, said apparatus including:

a first roll support to rotatably support a first roll of said material so that the material can be removed therefrom;

a second roll support to rotatably support a second roll of said material so that the material may be removed therefrom;

a first strip securing member to engage and retain and leading portion or trailing portion of the strip material of the first roll;

a second strip securing member to engage and retain and leading or trailing portion of the strip material of the second roll; and a strip transfer member to engage and retain each leading portion and move each leading portion from its respective securing member to the other securing member to provide for the attachment of each leading portion to the trailing portion of the other roll.

Preferably, each securing member includes apertures to which a reduced air pressure is applied so that the strip material is urged into contact therewith so that the leading and trailing portions of the strip material are secured thereto.

Preferably, said transfer member is reciprocated between a first position located adjacent said first securing member and a second position adjacent said second securing member.

Preferably, said transfer member includes apertures having a reduced air pressure so that the strip material is urged into contact therewith so as to be retained thereby.

Preferably, said transfer member includes an arm from which there is suspended a plate having said apertures, said plate being attached to a motor that causes movement of the plate to grasp and release the leading and trailing portions.

There is further disclosed herein in combination, the above splicing machine and said first roll and said second roll, and wherein the strip material of said first roll has a longitudinal printed face, and the strip material of said second roll also has a longitudinal printed face, and wherein material from said first roll is delivered to said first securing member with the printed face thereof having a predetermined orientation, and the material from said second roll is delivered to said second securing means with the printed face thereof also in said predetermined orientation so that when said leading end portion is attached to said trailing end portion the orientation of the printed faces are maintained.

There is further disclosed herein a method of joining strip material having a printed longitudinal face, said method including the steps of:

providing a first and a second roll of said material, each roll having a leading end portion and a trailing end portion;

removing material from said first roll past a predetermined location;

grasping the trailing portion of said first roll when at said predetermined location;

locating the leading portion of said second roll at a second predetermined location; and moving the trailing portion of said first roll to said second predetermined location and securing the trailing portion of said first roll to the leading portion of said second roll so that material is taken from said second roll with the printed faces of the material from said first roll and said second roll maintained in a predetermined orientation.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENT

Figure 1:
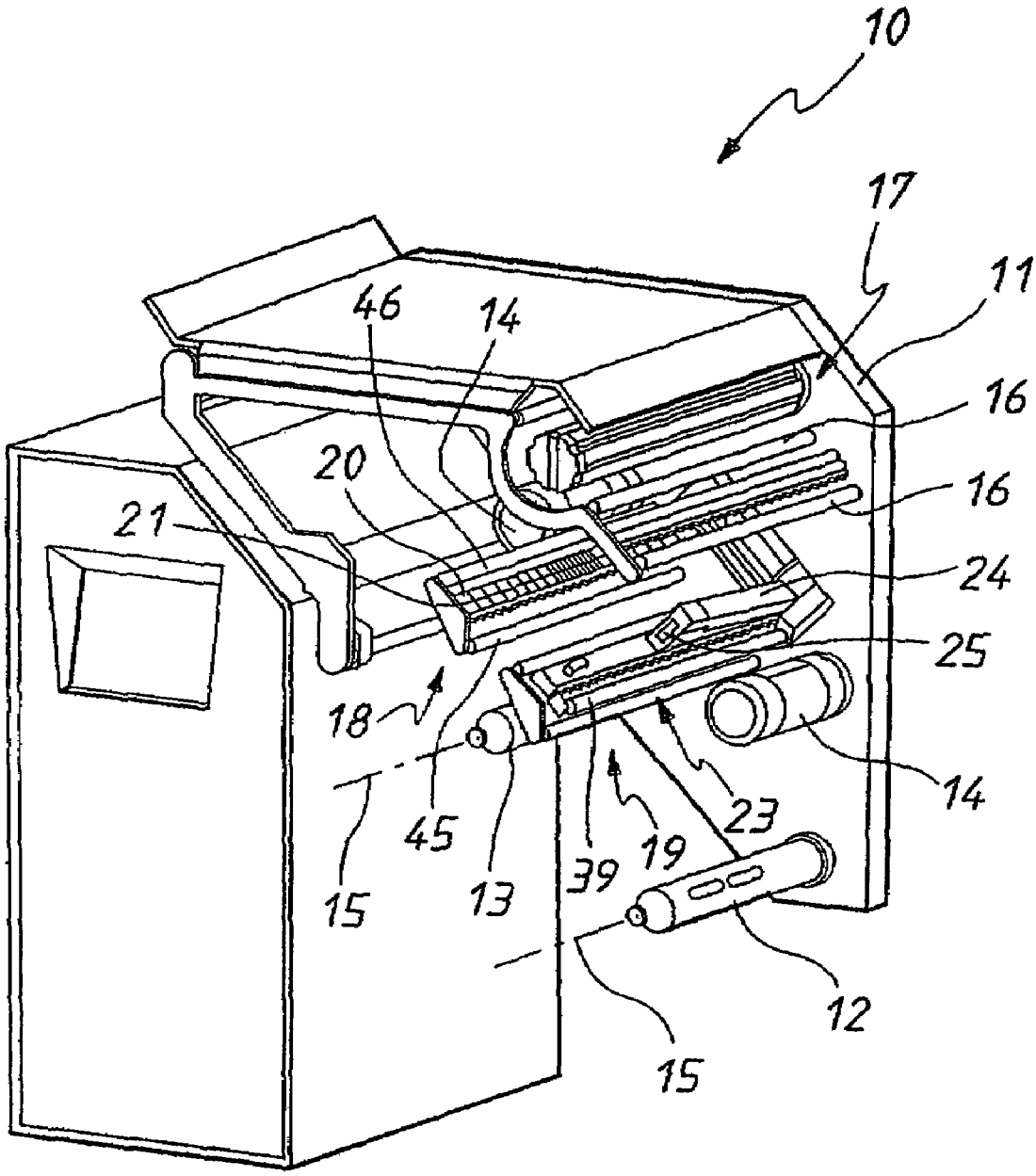
FIG. 1 is a schematic isometric view of a splicing machine to be used with a packaging machine.

In the accompanying drawings there is schematically depicted a splicing machine 10. For example the splicing machine 10 is intended to be used with the packaging machine of U.S. Pat. No. 4,663,917. The packaging machine of this USA Patent receives bag material in tubular form from a "former". The former has delivered to it the bag material in strip form and transforms it into the tubular configuration. The former receives a strip bag material from the splicing machine 10.

The splicing machine 10 includes a base 11 that includes a first roll support 12 and a second roll support 13. The roll supports 12 and 13 are rotatably driven by associated motors 14. More particularly the supports 12 and 13 are rotatably driven about parallel transversely spaced generally horizontal axes 15. Mounted on each support 12 and 13 is a roll 40 or 41 of the strip bag material 42. Initially one of the rolls 40, 41 would be delivering the strip bag material via rollers 16 to a bag material storage device 17. The device 17, for example, may be a web storage device such as described in Australian Patent Application No. 7544/02 (British Application No. 0207162.9; U.S. application Ser. No. 10/099,857 lodged 14 Mar. 2002). When the first roll 40, 41 is depleted the strip material 42 of the second roll 40, 41 has its leading portion joined to the trailing portion of the first roll 40, 41 by means of the splicing machine 10.

The machine 10 includes a first web securing member 18 that engages and retains the leading and trailing portions of the roll 41 mounted on the support 13. A second web securing member 19 engages and retains the leading portion and trailing portion of the roll 40 supported by the support 12. The members 18 and 19 have upwardly facing surfaces 20 each with a plurality of apertures 21 that communicate with passages having a reduced air pressure. Accordingly, strip bag material 42 is engaged and retained in position and can be released upon the reduced air pressure being relieved. Associated with each member 18 and 19 are rollers 43 and 44, and 45 and 46 respectively.

Figure 2:
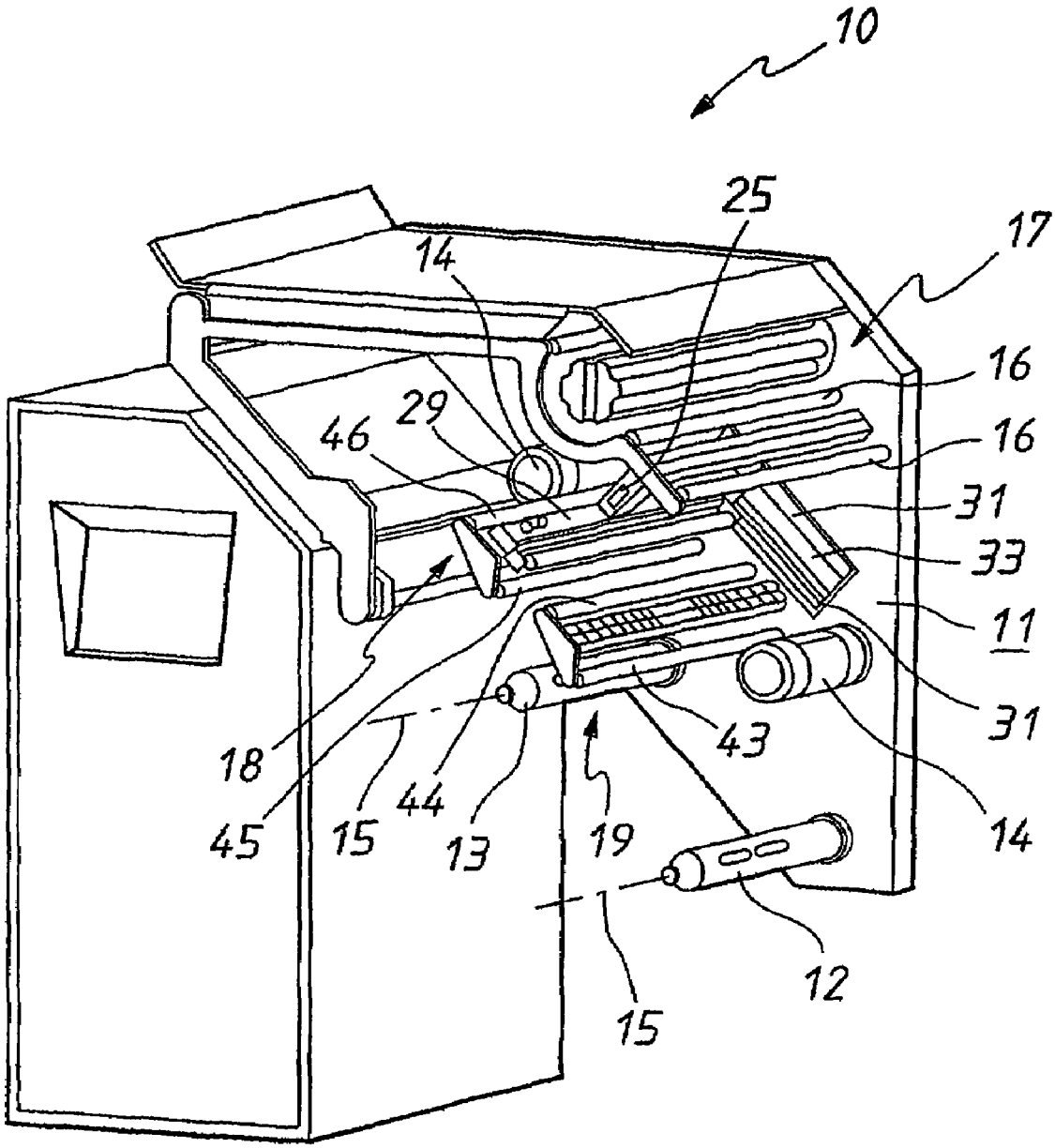
FIG. 2 is a further schematic isometric view of the splicing machine of FIG. 1.
Figure 3:
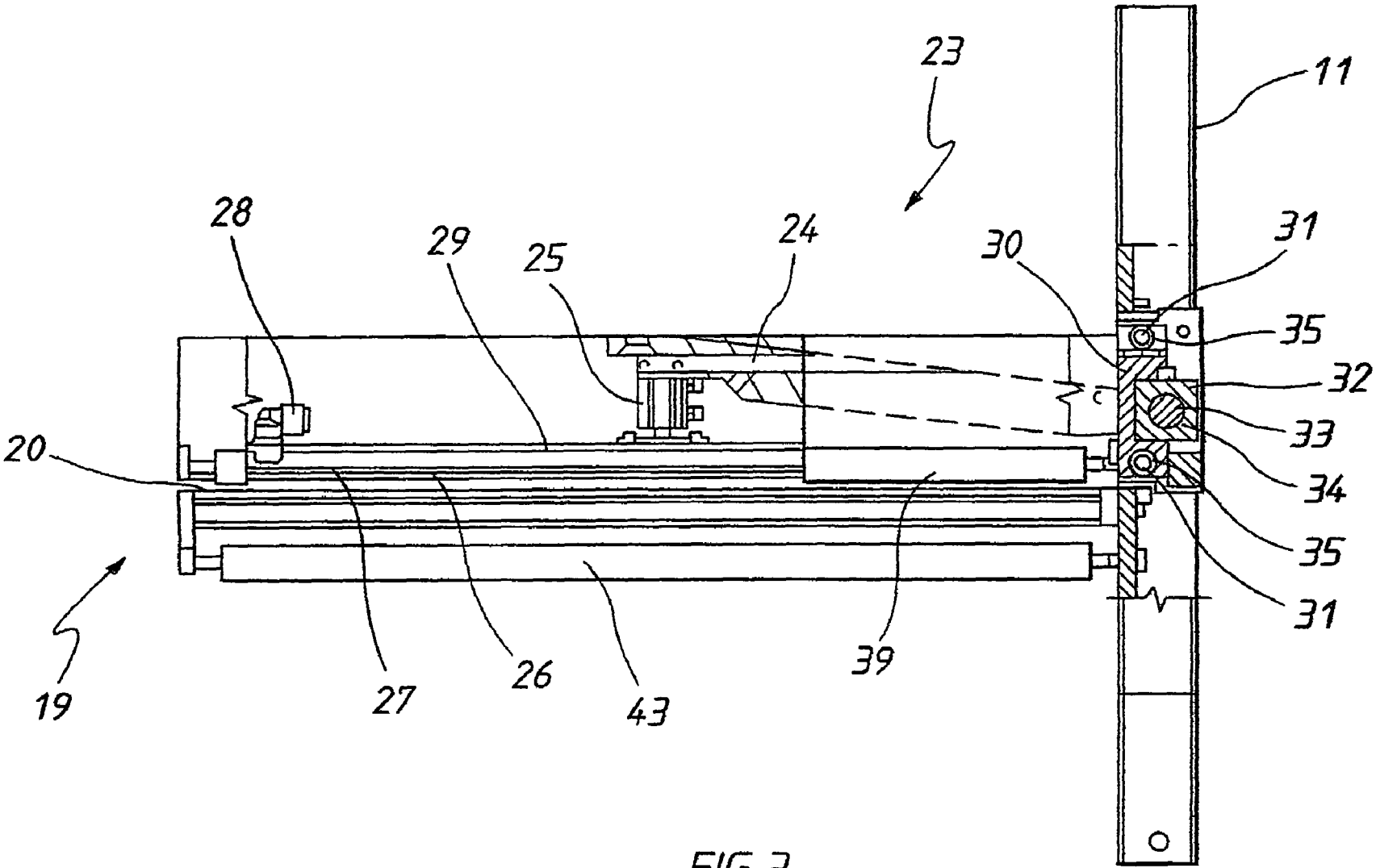
FIG. 3 is a schematic part sectioned side elevation of an arm of the machine of FIGS. 1 and 2.
Figure 4:
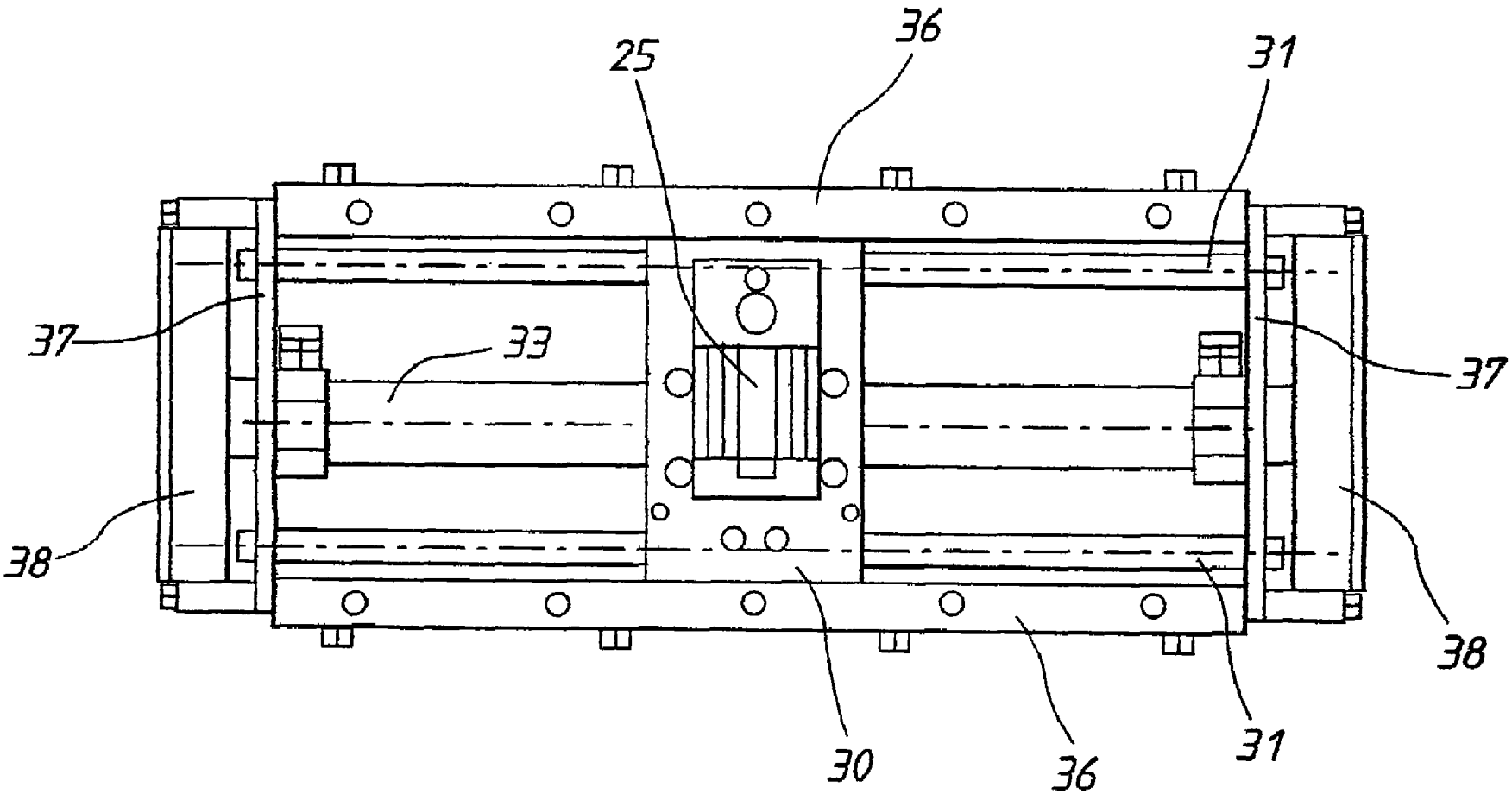
FIG. 4 is a schematic front elevation of a support for the arm of FIG. 3.

Also mounted on the base 11 is a web transfer member 23 that is mounted for reciprocal movement between a first (FIG. 1) and a second (FIG. 2) position. In the first position the web transfer member 23 is located adjacent the member 18 (FIG. 2), in the second position the web transfer member 23 is located adjacent the member 19 (FIG. 1). The web transfer member 23 includes an aperture plate 26 that communicates with a space 27 that has a reduced air pressure so that the strip bag material 42 is drawn into contact with the plate 26. The reduced air pressure is delivered to the space 27 by means of a coupling 28 that a flexible hose extends to.

The web transfer member 23 further includes an arm 24 that supports a pneumatic cylinder 25. The cylinder 25 is attached to a housing 29 to which the plate 26 is attached to co-operate therewith in providing the space 27. The plate 26 is raised and lowered by operation of the cylinder 25 by the delivery of air under pressure thereto.

The arm 24 is supported in a cantilever manner by the mounting block 30. The block 30 is slidably supported on a pair of rails 31 that are inclined to the horizontal and provide for the linear movement of the transfer member 23 between the first and second positions thereof. Attached to the block 30 is a sleeve 32 that is also slidably mounted on a cylinder 33. The cylinder 33 would be formed of aluminium and would contain a magnetic piston 34. The sleeve 32 would be also formed of magnetic material so as to be attracted to the piston 34. Air under pressure is delivered to opposite ends of the cylinder 33 to cause longitudinal movement of the piston 34 and therefore longitudinal movement of the sleeve 32 along the cylinder 33. This movement of the piston 34 and sleeve 32 provides the linear reciprocation of the transfer member 23.

The block 30 has upper and lower arcuate recesses 35 that slidably receive the rails 31. Abutting the rails 31 so as to provide support for the rails 31 are backing strips 36. The rails 31 and backing strips 36 extend between end plates 37 that are fixed to the base 11. Rollers 38 are located adjacent the ends of the cylinder 33. Passing between the rollers is a flexible cover that is also attached to the block 30 so as to move therewith to close the apertures adjacent the block 30.

Attached to the block 30 is a roller 39 so as to move therewith.

In respect of the rolls 40 and 41 of strip material 42 it should be appreciated that one longitudinal face thereof is printed. Accordingly, the strip material 42 must be delivered to the "former" in a predetermined orientation so that the printing on the bags is on the exterior. A further issue in respect of joining the material 42 from the rolls 40 and 41 is that the trailing end portion of one of the rolls 40, 41 is joined to the leading end portion of the other roll 40, 41 by means of tape applied to the non printed surface of the strip material 42. This ensures that the adhesive tape does not engage the surfaces of the "former" and is peeled from the material 42 by the former. It is also preferable that the material 42 be joined so that the end edge of trailing portion is adjacent the end edge of the leading portion so that they substantially abut.

Figure 5:
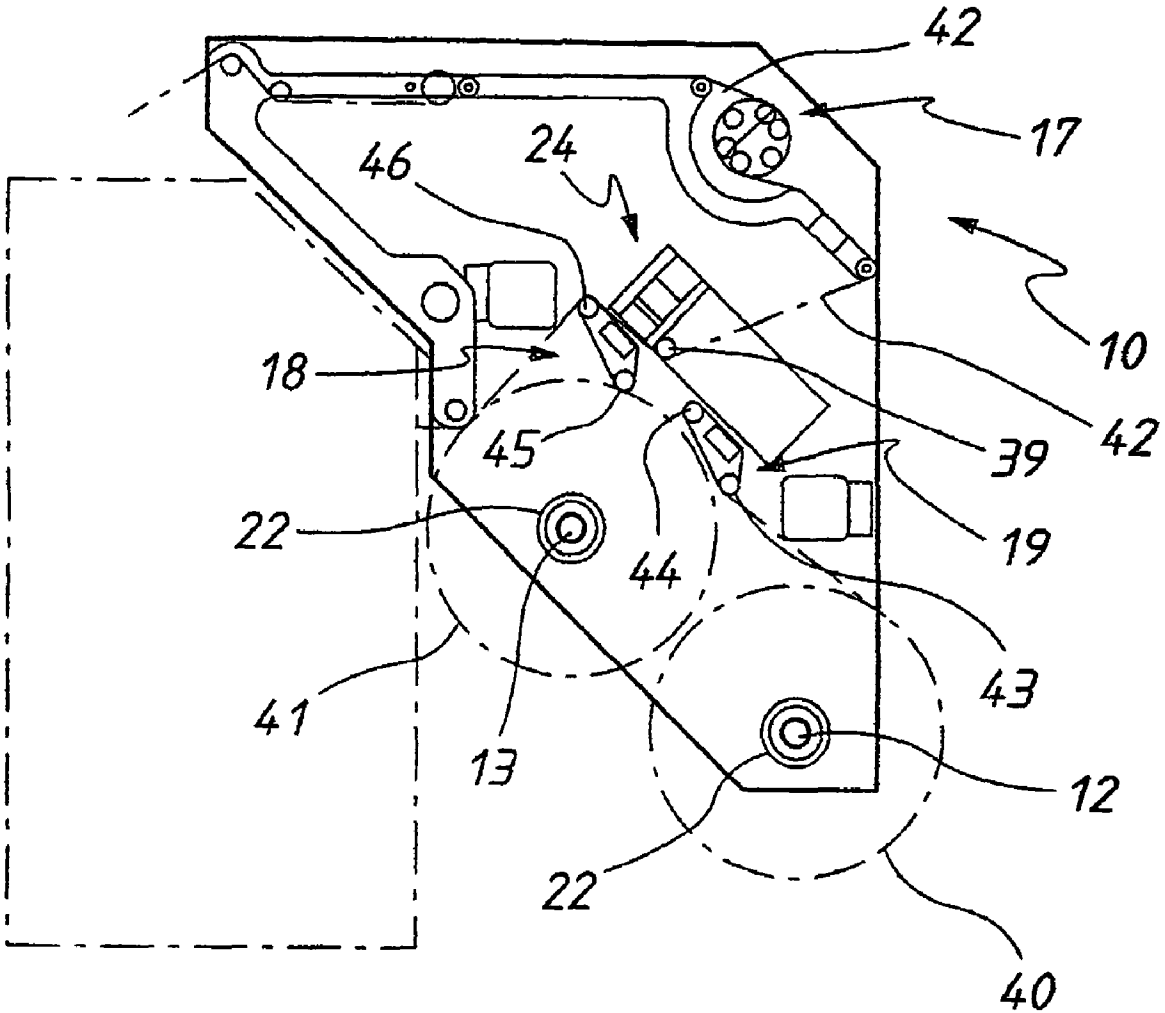
FIG. 5 is a schematic side elevation of the machine of FIGS. 1 and 2 showing the path of travel of strip material therethrough.
Figure 6:
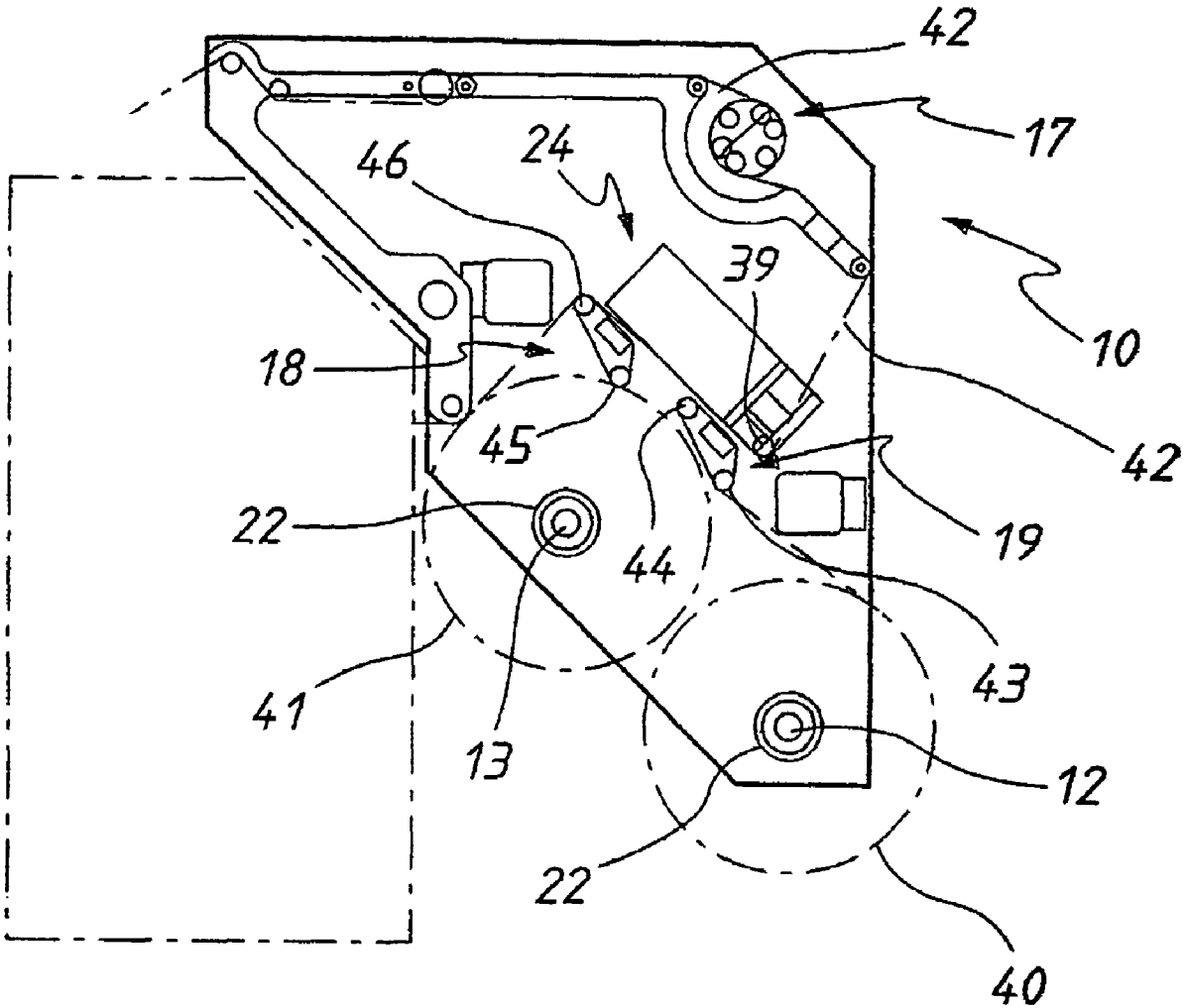
FIG. 6 is a further schematic side elevation of the machine of FIGS. 1 and 2 again with the path of strip material passing therethrough.

As best seen in FIGS. 5 and 6 the strip material 42 from the roll 41 passes about the roller 46 to pass over the surface 20 of the member 18. In respect of the roll 40 the strip material 42 passes over the roller 43 and then around the roller 44 to pass over the face 20 of the member 19.

If we consider the roll 41 as being operated to provide the material 42 (see FIG. 5), the leading end portion of the roll 40 is secured in place on the surface 20 of the member 19. Adjacent the edge of the leading end portion and extending therefrom is a strip of adhesive tape. The leading end portion and adhesive tape are retained in position by air pressure as a result of reduced air pressure being delivered to the apertures 21 of the surface 20 of the member 19.

Associated with each of the supports 12 and 13 and/or the device 17 are sensors that detect when either of the rolls 40 and 41 is depleted. In this respect it should be appreciated that each roll 40 and 41 includes a core 22 to which the material 42 is releasably attached. However to release the material 42 a resistance is encountered. This resistance is detected using the motors 14. Accordingly, the machine 10 can detect when either of the rolls 40 or 41 is depleted. The distance between the core 22 and the respective securing member 18 or 19 is known and therefore it can be determined when the trailing end portion of the depleted roll will reach its respective securing member 18 or 19.

For example, if the roll 41 (see FIG. 5) is being used and becomes depleted the trailing end portion thereof ultimately reaches the surface 20 of the member 18. At that time the device 17 ceases taking in material 42 but delivers stored material 42 to the downstream "former". The plate 26 is lowered and engages the trailing end portion of the strip material 42 from the roll 41. At this time air pressure is raised at the apertures 21 releasing the trailing end portion and air pressure lowered at plate 26, so that the trailing end portion of the roll 41 can be transported to the securing member 19 (see FIG. 6). To facilitate this, the plate 26 is raised. Already at the securing member 19 and applied to the surface 20 thereof is the leading end portion of the strip material 42 of the roll 40. It is held in position by reduced air pressure being applied to the apertures 21 of the surface 20 of the member 19. The leading end portion has applied to it adhesive tape that extends beyond the edge of the leading end portion with the adhesive facing upward. When the arm 24 locates the plate 26 adjacent the leading edge portion from the roll 40 and its associated tape, again the cylinder 25 is actuated so that the plate 26 moves to engage the trailing end portion of the roll 41 with the adhesive tape. The plate 26 is then raised. Motion of the material 42 is then recommenced with the end portions attached. By means of this operation the printed side of the strip material 42 is maintained correctly oriented and the tape applied to the non printed surface so as not to engage the former.

The material 42 leaving the members 18 and 19 passes about the roller 39.

When depletion of the roll 40 is detected the trailing end portion is secured in position on the member 19 again by applying reduced air pressure to the surface 20 of the member 19. The plate 26 is lowered to engage the trailing end portion, with the trailing end portion being released by the member 19. The arm 24 raises the plate 26 and moves to the member 18 so that the trailing end portion of the roll 40 is secured to the leading end portion of a new roll 41, which leading end portion is located on the surface 20 of the member 18 with its adhesive tape ready secured. The process is then repeated.

When a trailing end portion is being secured to a leading end portion the strip material 42 downstream of the device 17 is halted.

The downstream packaging machine would be programmed to expect to receive bag material with a join. Bags made with the join would then be removed from the production line.

A control mechanism would co-ordinate operation of the delivery of reduced air pressure to the members 18 and 19 and the plate 26 together with movement of the transfer member 23.

The invention claimed is:

1. A splicing machine to join flexible strip material provided in rolls, each roll having a strip leading portion and a strip trailing portion, said apparatus including:

a first roll support to rotatably support a first one of the rolls so that the material can be removed therefrom;

a second roll support to rotatably support a second one of the rolls so that the material may be removed therefrom;

a first strip securing member selectively operable to engage and retain either the leading portion or the trailing portion of the first roll;

a second strip securing member selectively operable to engage and retain either the leading or the trailing portion of the second roll; and a strip transfer member to alternately engage and retain each trailing portion and move the trailing portion engaged by the transfer member from its respective securing member to the other securing member to provide for the attachment of the trailing portion engaged by the transfer member to the leading portion of the other roll.

2. The machine of claim 1, wherein each securing member includes apertures to which a reduced air pressure is applied so that the strip material is urged into contact therewith so that the leading portion of one of the rolls and the trailing portion of the other roll are secured thereto.

3. The machine of claim 2, wherein said transfer member is reciprocated between a first position located adjacent said first securing member and a second position adjacent said second securing member.

4. The machine of claim 3, wherein said transfer member includes apertures having a reduced air pressure so that the strip material is urged into contact therewith so as to be retained thereby.

5. The machine of claim 4, wherein said transfer member includes an arm from which there is suspended a plate having said apertures, said plate being attached to a motor that causes movement of the plate to grasp and release the leading and trailing portions.

6. In combination, the machine of claim 5, said first roll and said second roll, and wherein the strip material of said first roll has a longitudinal printed face, and the strip material of said second roll also has a longitudinal printed face, and wherein material from said first roll is delivered to said first securing member with the printed face thereof having a predetermined orientation, and the material from said second roll is delivered to said second securing means with the printed face thereof also in said predetermined orientation so that when said leading end portion is attached to said trailing end portion the orientation of the printed faces are maintained.

7. A splicing machine to join flexible strip material provided in rolls, each roll having a strip leading portion and a strip trailing portion, said apparatus including:

a first roll support to rotatably support a first one of the rolls so that the material can be removed therefrom;

a second roll support to rotatably support a second one of the rolls so that the material may be removed therefrom;

a first strip securing member selectively operable to engage and retain either the leading portion or the trailing portion of the first roll;

a second strip securing member selectively operable to engage and retain either the leading or the trailing portion of the second roll; and a strip transfer member to alternately engage and retain each trailing portion and move the trailing portion engaged by the transfer member from its respective securing member to the other securing member to provide for the attachment of the trailing portion engaged by the transfer member to the leading portion of the other roll and wherein said transfer member is reciprocated between a first position located adjacent said first securing member and a second position adjacent said second securing member.

8. The machine of claim 7, wherein said transfer member includes apertures having a reduced air pressure so that the strip material is urged into contact therewith so as to be retained thereby.

9. The machine of claim 8, wherein said transfer member includes an arm from which there is suspended a plate having said apertures, said plate being attached to a motor that causes movement of the plate to grasp and release the leading and trailing portions.

10. In combination, the machine of claim 9, said first roll and said second roll, and wherein the strip material of said first roll has a longitudinal printed face, and the strip material of said second roll also has a longitudinal printed face, and wherein material from said first roll is delivered to said first securing member with the printed face thereof having a predetermined orientation, and the material from said second roll is delivered to said second securing means with the printed face thereof also in said predetermined orientation so that when said leading end portion is attached to said trailing end portion the orientation of the printed faces are maintained.

11. A splicing machine to join flexible strip material provided in rolls, each roll having a strip leading portion and a strip trailing portion, said apparatus including:

a first roll support to rotatably support a first one of the rolls so that the material can be removed therefrom;

a second roll support to rotatably support a second one of the rolls so that the material may be removed therefrom;

a first strip securing member selectively operable to engage and retain either the leading portion or the trailing portion of the first roll;

a second strip securing member selectively operable to engage and retain either the leading or the trailing portion of the second roll; and a strip transfer member to alternately engage and retain each trailing portion and move the trailing portion engaged by the transfer member from its respective securing member to the other securing member to provide for the attachment of the trailing portion engaged by the transfer member to the leading portion of the other roll and wherein said transfer member includes apertures having a reduced air pressure so that the strip material is urged into contact therewith so as to be retained thereby.

12. The machine of claim 11, wherein each securing member includes apertures to which a reduced air pressure is applied so that the strip material is urged into contact therewith so that the leading portion of one of the rolls and the trailing portion of the other roll are secured thereto.

13. The machine of claim 12, wherein said transfer member is reciprocated between a first position located adjacent said first securing member and a second position adjacent said second securing member.

14. The machine of claim 12, wherein said transfer member includes an arm from which there is suspended a plate having said apertures, said plate being attached to a motor that causes movement of the plate to grasp and release the leading and trailing portions.

15. In combination, the machine of claim 14, said first roll and said second roll, and wherein the strip material of said first roll has a longitudinal printed face, and the strip material of said second roll also has a longitudinal printed face, and wherein material from said first roll is delivered to said first securing member with the printed face thereof having a predetermined orientation, and the material from said second roll is delivered to said second securing means with the printed face thereof also in said predetermined orientation so that when said leading end portion is attached to said trailing end portion the orientation of the printed faces are maintained.

16. A splicing machine to join flexible strip material provided in rolls, each roll having a strip leading portion and a strip trailing portion, said apparatus including:

a first roll support to rotatably support a first one of the rolls so that the material can be removed therefrom;

a second roll support to rotatably support a second one of the rolls so that the material may be removed therefrom;

a first strip securing member selectively operable to engage and retain either the leading portion or the trailing portion of the first roll;

a second strip securing member selectively operable to engage and retain either the leading or the trailing portion of the second roll; and a strip transfer member to alternately engage and retain each trailing portion and move the trailing portion engaged by the transfer member from its respective securing member to the other securing member to provide for the attachment of the trailing portion engaged by the transfer member to the leading portion of the other roll and wherein said transfer member includes an arm from which there is suspended a plate having said apertures, said plate being attached to a motor that causes movement of the plate to grasp and release the leading and trailing portions.

17. The machine of claim 16, wherein each securing member includes apertures to which a reduced air pressure is applied so that the strip material is urged into contact therewith so that the leading portion of one of the rolls and trailing portion of the other roll are secured thereto.

18. The machine of claim 17, wherein said transfer member is reciprocated between a first position located adjacent said first securing member and a second position adjacent said second securing member.

19. The machine of claim 18, wherein said transfer member includes apertures having a reduced air pressure so that the strip material is urged into contact therewith so as to be retained thereby.

20. In combination, the machine of claim 19, said first roll and said second roll, and wherein the strip material of said first roll has a longitudinal printed face, and the strip material of said second roll also has a longitudinal printed face, and wherein material from said first roll is delivered to said first securing member with the printed face thereof having a predetermined orientation, and the material from said second roll is delivered to said second securing means with the printed face thereof also in said predetermined orientation so that when said leading end portion is attached to said trailing end portion the orientation of the printed faces are maintained.

* * * * *